United States Patent [19]

Jordan et al.

[11] 4,206,789

[45] Jun. 10, 1980

[54] ARRANGEMENT FOR FILLING LIQUIDS INTO A CONTAINER

[76] Inventors: Heinrich Jordan, Wormsstr. 13, 4600 Dortmund 1; Uwe Knabe, Wickeder Chaussee 213, 4600 Dortmund 13, both of Fed. Rep. of Germany

[21] Appl. No.: 950,000

[22] Filed: Oct. 10, 1978

[30] Foreign Application Priority Data

Oct. 11, 1977 [DE] Fed. Rep. of Germany ..... 2745642

[51] Int. Cl.[2] ..... B65B 3/04; B65B 31/00

[52] U.S. Cl. ..... 141/39; 141/57; 141/303

[58] Field of Search ..... 141/6, 37, 39, 40, 42, 141/44, 46, 52, 54, 57, 198, 285, 302, 303, 207, 208, 292

[56] References Cited

U.S. PATENT DOCUMENTS

| | | | |
|---|---|---|---|
| 3,032,077 | 5/1962 | Plock et al. | 141/39 |
| 3,090,408 | 5/1963 | Naecker | 141/302 X |
| 3,782,427 | 1/1974 | Zeimet et al. | 141/39 |

*Primary Examiner*—Frederick R. Schmidt
*Attorney, Agent, or Firm*—Michael J. Striker

[57] ABSTRACT

A device for use in filling bottles with liquid stored in a reservoir is disclosed. The device utilizes a short gas conduit for venting the bottle to be filled. When the level of liquid reaches the level of the conduit, the outflow of gas displaced during the filling process ceases and the filling process is greatly slowed. Liquid which is drawn into the conduit is blocked by a check valve which does not impede gas flow. After such blockage, the device is so constructed as to allow the liquid to drain back into the bottle. This single conduit is used for both the intake and exhausting of gas, as may be required during the filling process.

7 Claims, 1 Drawing Figure

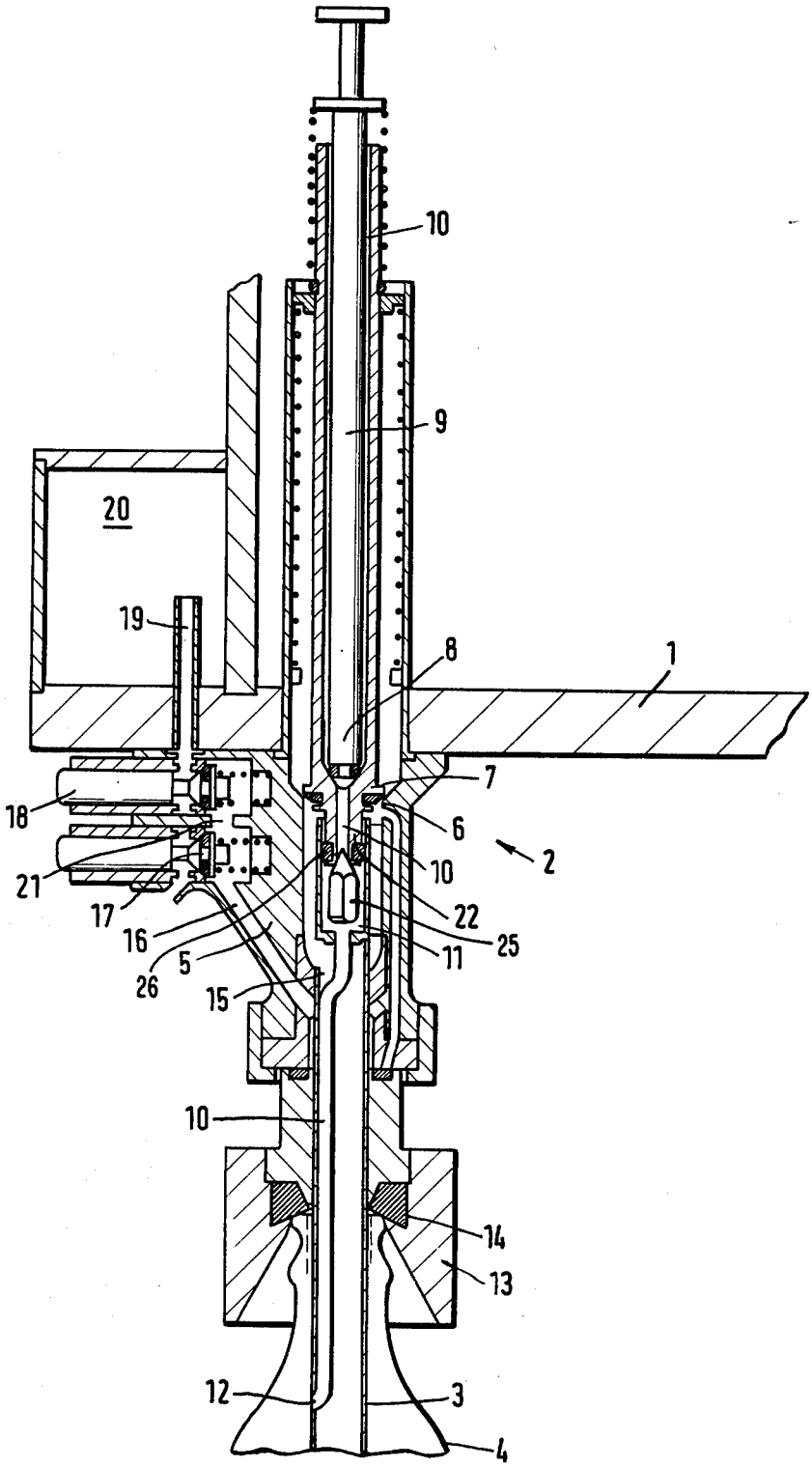
10
9
20
19
8
1
7
18
6
2
10
21
22
17
16
25
11
5
26
15
10
14
13
12
3
4

ARRANGEMENT FOR FILLING LIQUIDS INTO A CONTAINER

BACKGROUND OF THE INVENTION

The invention relates to a filling device or arrangement for filling pipe filling machines for filling drinkable liquids into containers, such as bottles or the like, with a filling liquid annulus vessel and with filling components connected thereto by a liquid input conduit and a gas conduit having a gas valve arranged thereat.

A known filling valve with a long filling pipe according to German offenlegungsschrift 2,234,120 is provided with a receptacle relief means with separate liquid pressurization and return gas paths, either including a separate liquid and pressurized chamber, as well as with a return gas chamber communicating with the atmosphere. The valve controlled pressurized gas path opens into the receptacle to be filled through a piercing recess in the filling pipe disk, and the return gas path, in the gas travel direction, consists of a channel extending along the filling pipe to a self-closing valve and having a chamfer at the side of the receptacle, and a main conduit continuing the channel to the gas chamber, with interposed return gas valve and a throttle arranged behind the same, as well as a conduit which branches off beyond the closing ball valve.

In these known filling devices, extremely long paths result for the pre-pressurizing, as well as for the return gas channels. These paths constitute a considerable passage resistance and form a correspondingly large expansion space. This leads to substantial foaming losses during the de-pressurization of the receptacle, particularly during the filling of beverages containing $CO_2$.

SUMMARY OF THE INVENTION

Accordingly, it is an object of the invention to eliminate the disadvantages of known filling devices and to provide a short path for the pressurizing as well as for the return gas, so that only minute conduit resistances are encountered and the expansion space, especially during system relief, is kept as small as possible.

This object is accomplished according to the invention in that a common conduit is provided having a first portion for the input and output of the pre-pressurizing and return gas, which first portion passes through the valve body and communicates with a centrally situated float space surrounded by the liquid conduit, the upper end face of which is formed by the tubular nipple of the valve body and guided into the float space for movement upwardly and downwardly, and, a second portion extending centrally from the float space and adjacent the inner jacket of the filling pipe, which is conducted, in a manner which is known, through the filling pipe outwardly into the container space and determines the filling height level with its opening part.

In a further embodiment of the invention, it is proposed that the closing body of the filling valve is centered in the stationary float space by a shoulder.

The initially mentioned disadvantages of the known filling elements are avoided by the proposed construction. There results an almost straight-lined and short path for the pre-pressurizing as well as for the return gas, so that conduit resistances, which are caused by alterations of the direction of flow or the like, are avoided. Moreover, only a small expansion space exists, which permits a disturbance-free depressurization of the gas passageways.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

The single FIGURE of the drawing is a view showing a filling arrangement in accordance with the present invention, in section.

DESCRIPTION OF A PREFERRED EMBODIMENT

According to the illustrated example of the embodiment, the filling machine consists of a rotating annular reservoir 1 will filling components 2 positioned thereat, the filling pipe 3 proper of which extends downwardly and is introducible into a bottle 4. The filling pipe is rigidly connected with a control head 5. The latter also forms the valve seat 6, on which there rests a valve body 7 which is displaceable in the axial direction. A gas valve 8 with an outwardly conducted control rod 9 is arranged within the valve body. The valve body is penetrated by an advance and return gas conduit 10 which communicates, through a tubular nipple 22, with a float valve housing 11 from which the advance and return gas conduit 10 extends all the way into the receptacle space. To this end, the filling pipe 3 is provided with a part 12 which simultaneously determines the filling height proper. A centering element 13 with a seal 14 is guided in the axial direction on the filling pipe 3. These parts form, with the pressed-on receptacle 4 and the control head 5, a chamber 15 which is sealed with respect to the atmosphere and which, in turn, is in communication with a relief passageway 16 and a relief valve 17. Moreover, a further valve 18 is arranged in the control head 5, and a conduit 19 extends from the same into an annular channel 20 which is additionally arranged in the annular reservoir 1. A further passageway 21 communicates the valve chamber with the space 15 or with the bottle space. The tubular nipple 22 is equipped with a groove ring 26, the sealing lip of which is oriented downwardly toward the receptacle. In this manner, there is obtained an almost frictionless guidance of the tubular nipple within the float housing 11, so tht an easy opening of the valve body is obtained.

The filling operation commences with the opening of the gas valve 8. This occurs in that a control pinion, which is not illustrated and which is supported in the annular reservoir 1, comes in contact with stationary control elements and lifts the control rod 9. As a result of this, pressure equilibrium is established between the receptacle and the reservoir 1, which then opens the valve body 7 which is spring loaded. The liquid then flows from the reservoir in accordance with the geodetic slope into the receptacle 4. When the part 12 of the filling pipe 3 is reached, by the rising liquid no more gas exchange takes place so that filling is greatly slowed up. However, a part of the liquid still continues to rise through the port into the advance and return conduit 10 up to approximately the elevation of the float housing 11. The needle-nosed float body 25 is then placed upwardly by the rising liquid and pressed into the opening of the further extending channel 10, so that liquid flow from the reservoir ceases.

After this cessation the relief valve 17 is opened, as a result of which the superatmospheric pressure in the bottle and chamber i s ported to the atmosphere and the liquid which has risen into the float housing flows back into the bottle. In this manner, the filling operation is completed. The filled bottle can then be lowered and transported out of the filling machine.

It may now be seen that three valves come into play during the filling stage prior to system relief via valve 17. Gas flow control valve 8 allows filling to take place by venting the interior of the bottle during filling. Liquid flow control valve (composed of seat 6 and body 7) allows the liquid to flow into the bottom from the reservoir. A check valve, formed from needle-nosed valve body 25 located in housing 11 and nipple 22, prevents the liquid that rises up into conduit 10 from clogging the gas valve, while permitting gas flow through itself in both directions.

As a result of the relatively short gas flow path, no disturbance from liquid penetrating into the passageways takes place. Any liquid residue present above the float valve automatically drains downwardly.

It will be understood that each of the elements described above, or two or more together, may also find a useful application in other types of constructions differing from the types described above.

While the invention has been illustrated and described as embodied in a filling arrangement of a filling pipe filling machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A device for use in filling machines which fill bottles and the like with liquids, comprising:

(a) a vertically elongated hollow filling pipe with a top end and a bottom end and an interior extending downwardly through the top of the bottle to be filled, the pipe having a port located at a predetermined height to which the bottle is to be filled and the pipe extending downwardly to a point within the bottle which point is intermediate the port and the bottom of the bottle, whereby liquid can be introduced into the bottle through the bottom end of the pipe;

(b) a vertically elongated hollow gas conduit with an interior, a top end and a bottom end, the volume of the interior of the conduit being small with respect to the volume of the interior of the pipe, the conduit being located at least partially inside the pipe and the lower end of the conduit being secured to the periphery of the port in a manner that the interior of the pipe does not communicate with the interior of the conduit, whereby the gas displaced by the flow of liquid into the bottle through the filler pipe can flow upwardly into the port, up through the conduit and out of the bottle to facilitate a continuous and smooth flow of liquid into the bottle;

(c) a liquid flow control valve associated with the top end of the pipe and communicating with the interior of the pipe to regulate the flow of liquid from a reservoir into the top end of the pipe;

(d) a check valve with an intake end and an exhaust end, the intake end being associated with the top end of the conduit and communicating with the interior of the conduit to allow gas to pass through the check valve in either direction while substantially preventing liquid entering the check valve intake end from passing through the check valve exhaust end; and (e) a gas flow control valve associated with the check valve exhaust end and communicating with the interior of the check valve to regulate the flow of gas in the check valve, whereby the flow of gas through the conduit may be regulated;

(f) a relief valve associated with the top end of the pipe and further associated with the outside atmosphere, the relief valve being normally closed and keeping the interior of the pipe isolated from the atmosphere and being operable to port the interior of the pipe and thereby the top of the bottle to the atmosphere and allow any liquid in the conduit to flow downwardly into the bottle;

g. a housing containing the relief valve and having a control chamber, the housing and the top end of the pipe being secured together in a manner that the interior of the pipe communicates with the chamber and the relief valve and the liquid flow control valve communicate with the chamber in order to accomplish the association;

h. a fixed lower element and a movable vertically elongated upper element, the lower element containing the chamber and being fixedly secured to the top end of the pipe and top end of the conduit, the upper element containing the gas flow control valve, the liquid flow control valve being formed by cooperation between mating portions of the upper element and the lower element; and i. wherein the lower element includes an integral tubular valve housing with a hollow interior which housing is surrounded by the chamber, connected to the top end of the conduit, and contains a needle-nose float body which is free to move therein, the housing cooperating with a tubular nipple on the upper element and the float body to form the check valve.

2. The device of claim 1 wherein the liquid flow control valve is located above the chamber.

3. The device of claim 2 wherein the gas flow control valve is located above the liquid flow control valve.

4. The device of claim 1 wherein the liquid flow control valve is responsive to pressure equilibrium between the reservoir and the interior of the pipe.

5. The device of claim 1 wherein the lower element has passageways formed therein and wherein the relief valve is located in the lower element and communicates with the chamber via the passageways.

6. The device of claim 1 wherein the upper element contains a central hollow axial bore, the device further including an elongated rod in the bore, the gas flow control valve being formed by mating portions of the rod and the upper element.

7. A mutliple-valve manifold for use in filling containers, comprising:

(a) a fixed lower element with a substantially central open chamber and a tubular check valve housing, surrounded by the chamber and having an open top and an open bottom, the lower element containing passageways which communicate with the chamber and having an integral valve seat portion located above the chamber and communicating therewith;

(b) a vertically elongated filling pipe with an interior, an open top end and an open bottom end, the pipe being secured to the lower element at the top of the pipe end so that the interior of the pipe communicates with the chamber, and the pipe having a port intermediate its ends;

(c) a vertically elongated hollow gas conduit with an interior, an open top end and an open bottom end, the volume of the interior of the conduit being small with respect to the volume of the interior of the pipe, the conduit being connected to the periphery of the port at its bottom end and connected to the bottom of the housing at its top end in a manner that the interior of the conduit does not communicate with the interior of the pipe;

(d) a normally closed relief valve located in the lower member and communicating with the passageways so as to port the chamber to the outside only when the valve is open;

(e) a hollow, vertically elongated upper element having an axis and movable up and down along the axis, the upper element having (1) a radially outwardly extending annular valve seal which is matable to and separable from the valve seat portion of the lower element to form a liquid flow control valve, (2) a tubular nipple located below the valve seal, the nipple being located inside of and slidable up and down within the top of the check valve housing, and (3) a central axial bore extending completely through the upper element which bore has a narrow region extending between the nipple and the annular valve seal and a wide region extending upwardly from the annular valve seal and further has a hollow gas flow valve seat region located intermediate the narrow region and the wide region and places these regions in communication with each other;

(f) a needle-nosed float valve body located in the check valve housing and being free to move therein in a manner that the valve body forms a check valve for substantial prevention of fluid flow into the movable upper element in cooperation with the narrow region of the axial bore which is located in the tubular nipple; and (g) a vertically elongated bar with a top end and a bottom end, which bar is located inside the wide region of the bore in the upper element and is slidable upwardly and downwardly therein, the bottom end of the bar having a seal which is matable to and separable from the gas flow valve seat region to form a gas flow valve.

* * * * *